US007471908B2

(12) United States Patent
Soya et al.

(10) Patent No.: US 7,471,908 B2
(45) Date of Patent: Dec. 30, 2008

(54) IMAGE FORMING APPARATUS THAT FORMS ADJUSTMENT IMAGES HAVING DIFFERENT DENSITIES AND IMAGE FORMING METHOD OF CONTROLLING THE IMAGE FORMING APPARATUS

(75) Inventors: Takashi Soya, Abiko (JP); Junichi Noguchi, Suzhou (CN); Takashi Kanno, Kashiwa (JP); Shinichi Takata, Abiko (JP); Shigemichi Hamano, Abiko (JP); Kiyoshi Okamoto, Moriya (JP); Katsuyuki Yamazaki, Toride (JP); Tomoichiro Ohta, Sagamihara (JP)

(73) Assignee: Canon Kabushiki Kaisha (JP)

( * ) Notice: Subject to any disclaimer, the term of this patent is extended or adjusted under 35 U.S.C. 154(b) by 122 days.

(21) Appl. No.: 11/608,382

(22) Filed: Dec. 8, 2006

(65) Prior Publication Data

US 2007/0134013 A1 Jun. 14, 2007

(30) Foreign Application Priority Data

Dec. 8, 2005 (JP) ..... 2005-355281

(51) Int. Cl.
*G03G 15/00* (2006.01)
*G03G 15/01* (2006.01)

(52) U.S. Cl. ..... 399/49; 399/301

(58) Field of Classification Search ..... 399/49, 399/60, 72, 301; 347/116
See application file for complete search history.

(56) References Cited

U.S. PATENT DOCUMENTS 5,933,680 A * 8/1999 Nishimura ..... 399/49
6,564,021 B1 * 5/2003 Nakai et al. ..... 399/49
6,693,654 B2 * 2/2004 Shinohara ..... 347/116

FOREIGN PATENT DOCUMENTS

JP H03-251878 A 11/1991
JP H08-76527 A 3/1996
JP H10-142863 A 5/1998
JP 2004-198805 A 7/2004

* cited by examiner

*Primary Examiner*—Sandra L Brase
(74) *Attorney, Agent, or Firm*—Rossi, Kimms & McDowell, LLP

(57) ABSTRACT

An image forming apparatus which can improve image formation capability to a satisfactory degree while curbing the rise in running cost. An image forming device forms adjustment images having different densities on an image support member having a higher optical reflectivity than an optical reflectivity of the adjustment images. A reading reads the adjustment images. An output from the reading device is read at a predetermined number of readings or time interval between readings based on the densities of the adjustment images susceptible to the optical reflectivity of the image support member.

22 Claims, 14 Drawing Sheets

IMAGE FORMING APPARATUS THAT FORMS ADJUSTMENT IMAGES HAVING DIFFERENT DENSITIES AND IMAGE FORMING METHOD OF CONTROLLING THE IMAGE FORMING APPARATUS

BACKGROUND OF THE INVENTION

1. Field of the Invention

The present invention relates to an image forming apparatus and a method of controlling the same, and more particularly to an image forming apparatus that forms images on image support members and a method of controlling the same.

2. Description of the Related Art

Electrophotographic image forming apparatuses are equipped with four image forming stations that carry out electrophotographic processes to form color images, such as black, cyan, magenta, and yellow images, respectively. Each of the image forming stations forms an electrostatic latent image on a photosensitive drum as an image support member by radiating a laser beam from a laser or light from a light-emitting device such as an LED onto the photosensitive drum. The electrostatic latent image formed on the photosensitive drum is then developed by toner supplied from a developing device, so that a visible image (toner image) is formed on the photosensitive drum. The toner images of the respective colors are transferred in a superimposed state from the photosensitive drum onto a belt-like intermediate transfer member (intermediate transfer belt). The toner images thus transferred in the superimposed state are collectively transferred from the intermediate transfer member onto a recording material to form a color image thereon. It should be noted that the toner images of the respective colors may be directly transferred in the superimposed state onto the recording material without being transferred onto the intermediate transfer member. In such a case, the recording material is conveyed by a belt-like recording material conveying member (conveying belt).

The image forming apparatuses described above form a group of toner images (hereinafter referred to as "patch image") having different toner densities on the intermediate transfer belt or the conveying belt with respect to each color so as to carry out image adjustment. The toner densities of such patch images (hereinafter referred to as "patch densities") are detected by a density sensor. The detected patch densities are compared with the target density, and the comparison results are used as feedback on image forming conditions such as the amount of light exposure, developing bias, tone correction curve, and density correction table. Thus, the toner densities of color images which are formed on the recording material can be suitably controlled, so that color images with stable color tones can be obtained. Specifically, it is possible to prevent the densities of supplied toners from varying with changes in usage environment and usage conditions such as an increase in the number of prints and therefore prevent situations where color images cannot exhibit their original tone colors.

FIG. 12 is a view useful in explaining a patch image which is formed by the conventional image forming apparatuses.

As shown in FIG. 12, a patch image comprised of a plurality of toner images having different toner densities is formed with respect to each color. Each toner image (hereinafter referred to as "patch") is a rectangle of 20 mm×20 mm and contiguous to other patches. The patch image of each color is comprised of, for example, eight patches required to control the tone correction curve for each color to the target density.

The density sensor detects the patch density at a plurality of points such as ten points on each patch so as to reduce the effects of unevenness in the accuracy of reading patches caused by the intermediate transfer belt or the conveying belt. For this reason, the average value of patch densities obtained by reading (hereinafter referred to as "sampling" also) at ten points is typically used as the reading result.

On the other hand, in controlling the toner density as described above, toners have to be consumed so as to form patch images and/or clean formed patches. This causes an increase in the running cost of the image forming apparatuses. To address this problem, four techniques as described below have been proposed.

The first technique compares a detected patch density with the target density and change the formation cycle of patch images which are subsequently formed (see Japanese Laid-Open Patent Publication (Kokai) No. H03-251878, for example). With this technique, by decreasing patch image formation cycles, toner consumption is reduced to curb the rise in running cost.

The second technique changes the lengths of patches (forming intervals) in the direction in which the patches are read using characteristics of tone correction curves. Specifically, patch forming intervals for high-density areas and low-density areas are set to be short (see Japanese Laid-Open Patent Publication (Kokai) No. H08-076527, for example). With this technique, toner consumption required to control toner density can be minimized to curb the rise in running cost.

The third technique changes the image densities of patches and the number of patches according to the circumstances surrounding an image forming apparatus, i.e. usage environment (see Japanese Laid-Open Patent Publication (Kokai) No. 2004-198805, for example). With this technique, a desired tone can be maintained in a stable manner over a wide tone range, and the image densities of patches and the number of patches can be minimized to curb the rise in running cost.

The fourth technique sets the number of times a shadow area where the sensor's detection range is narrow to a large value relative to the range of densities to be detected (see Japanese Laid-Open Patent Publication (Kokai) No. H10-142863, for example). With this technique, the accuracy of correcting processing in a shadow area can be improved.

With the first and second techniques, however, even if the patch image formation cycles or the patch formation intervals are changed, the period of time required to control the toner density remains unchanged in one formation cycle. It is therefore impossible to prevent degradation in the image formation capability of an image forming apparatus.

Also, with the third technique, even if the image densities of patches and the number of patches are changed according to the usage environment of an image forming apparatus, the correction time required to control the toner density for each patch remains unchanged. It is therefore impossible to satisfactorily improve the image formation capability of an image forming apparatus.

Also, with the fourth technique, the number of times a shadow area is read is increased relative to the total number of times all the areas are read so as to improve the accuracy of correcting processing. Since the total number of times all the areas are read remains unchanged, it is impossible to reduce processing time and downtime. Also, to increase the number of times a shadow area is read, the shadow area has to be long, resulting in increased toner consumption.

SUMMARY OF THE INVENTION

It is an object of the present invention to provide an image forming apparatus and a method of controlling the apparatus that can improve image formation capability to a satisfactory degree while curbing the rise in running cost.

To attain the above object, in a first aspect of the present invention, there is provided an image forming apparatus that carries out image formation, comprising: an image forming device that forms adjustment images having different densities on an image support member having a higher optical reflectivity than an optical reflectivity of the adjustment images; and a reading device that reads the adjustment images, wherein an output from the reading device is read at a predetermined number of readings or time interval between readings based on the densities of the adjustment images susceptible to the optical reflectivity of the image support member.

To attain the above object, in a second aspect of the present invention, there is provided an image forming apparatus that carries out image formation, comprising: an image forming device that forms adjustment images having different densities on an image support member having a higher optical reflectivity than an optical reflectivity of the adjustment images so as to carry out image adjustment; and a reading device that reads the adjustment images, wherein an output from the reading device is read with the number of readings in reading an output from the reading device to a large value or with the time interval between readings set to a small value when the densities of the adjustment images are low, and with the number of readings set to a small value or with the time interval between readings set to a large value when the densities of the adjustment images are high.

To attain the above object, in a third aspect of the present invention, there is provided a method of controlling an image forming apparatus that carries out image formation, comprising: an image forming step of forming adjustment images having different densities on an image support member having a higher optical reflectivity than an optical reflectivity of the adjustment images; and a reading step of reading the adjustment images, wherein an output from the reading device is read at a predetermined number of readings or time interval between readings based on the densities of the adjustment images susceptible to the optical reflectivity of the image support member.

To attain the above object, in a fourth aspect of the present invention, there is provided a method of controlling an image forming apparatus that carries out image formation, comprising: an image forming step of forming adjustment images having different densities on an image support member having a higher optical reflectivity than an optical reflectivity of the adjustment images so as to carry out image adjustment; and a reading step of reading the adjustment images, wherein an output in the reading step is read with the number of readings set to a large value or with the time interval between readings set to a small value when the densities of the adjustment images are low, and with the number of readings set to a small value or with the time interval between readings set to a large value when the densities of the adjustment images are high.

With the above arrangement, adjustment images are formed on the image support member. The adjustment images having different densities so as to carry out image adjustment are read by the reading device. The optical reflectivity of the image support member is higher than that of patches. An output from the reading device is read with the number of readings set to a large value or with the time interval between readings set to a small value when the densities of the adjustment images are susceptible to the optical reflectivity of the image support member. Also, the output from the reading device is read with the number of readings set to a small value or with the time interval between readings set to a large value when the densities of the adjustment images are less susceptible to the optical reflectivity of the image support member. Thus, the number of readings or the time interval between readings can be suitably controlled to improve image formation capability to a satisfactory degree while curbing the rise in running cost.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the accompanying drawings showing a preferred embodiment thereof.

Figure 1:
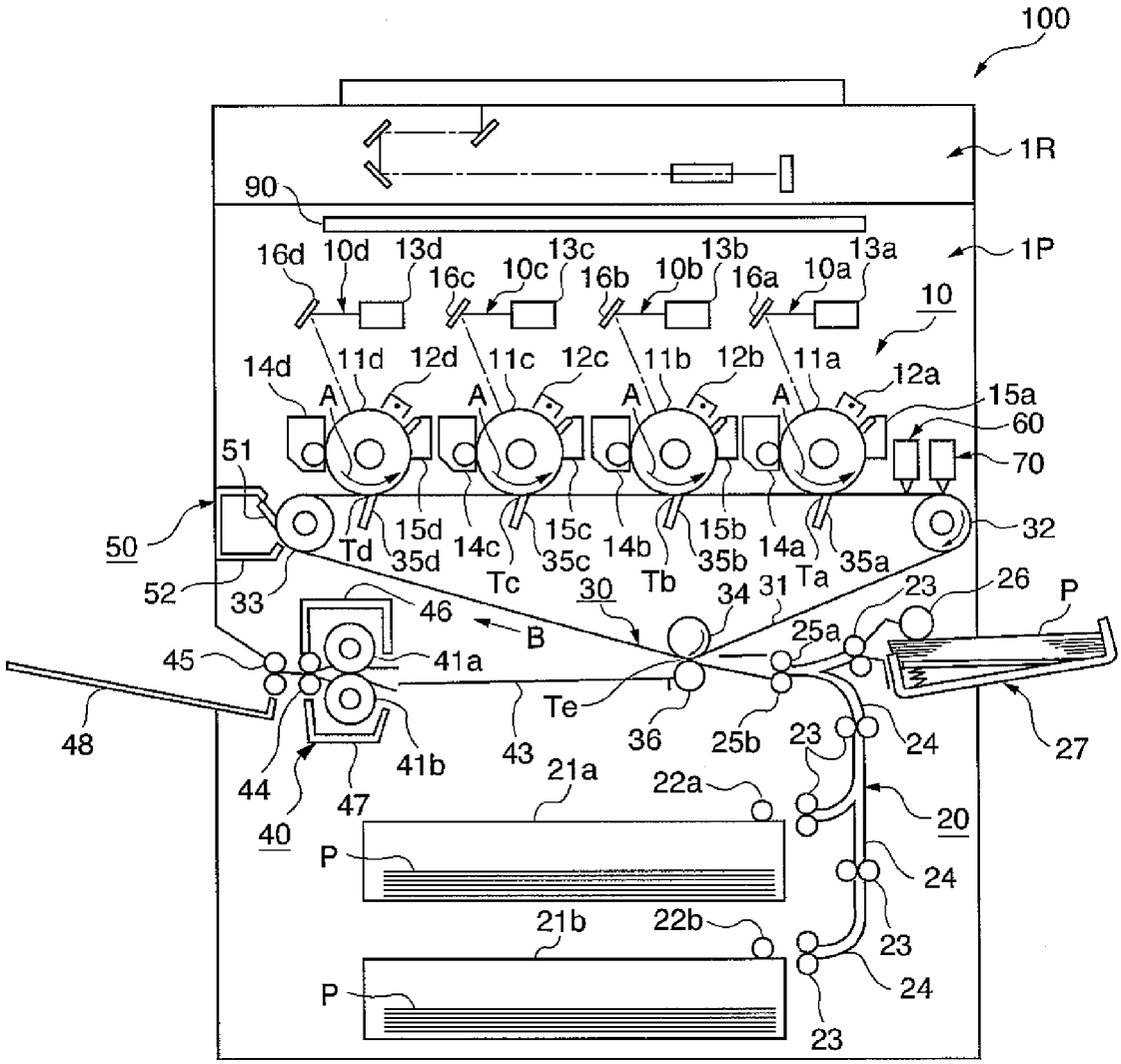
FIG. 1 is a longitudinal sectional view schematically showing the construction of an image forming apparatus according to an embodiment of the present invention.

FIG. 1 is a longitudinal sectional view schematically showing the construction of an image forming apparatus according to an embodiment of the present invention.

An electrophotographic color copying machine 100 is comprised of an image reading section 1R that reads images on originals as image signals, and an image output section 1P that forms images on an intermediate transfer member based on image signals received from the image reading section 1R.

Figure 2:
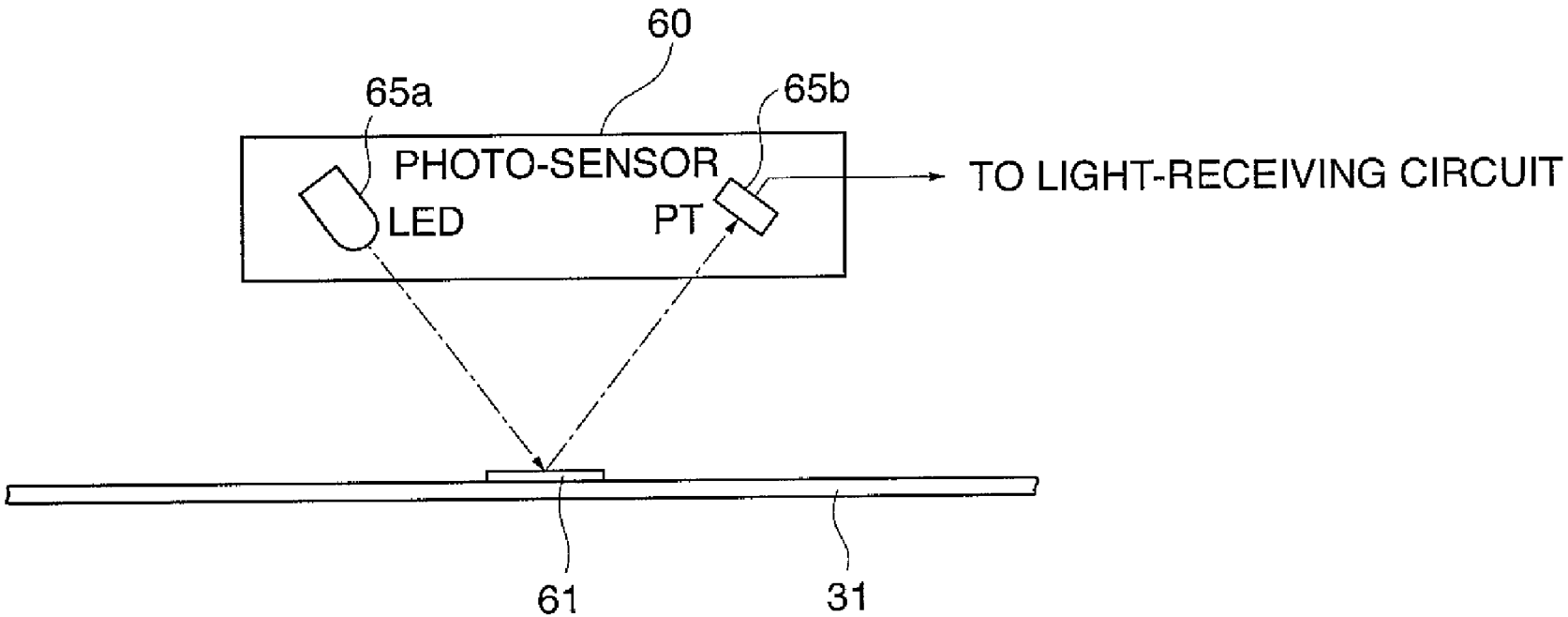
FIG. 2 is a block diagram showing in detail the construction of photo-sensors appearing in FIG. 1.
Figure 4A:
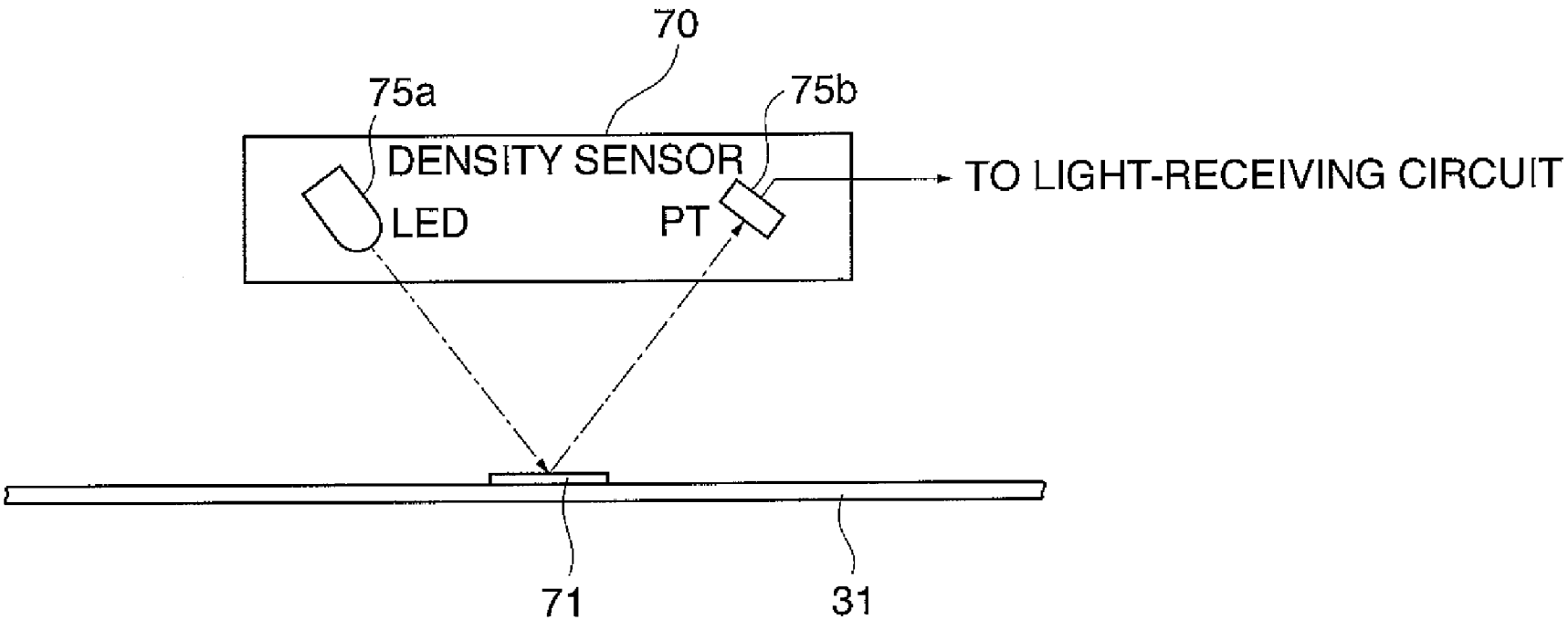
FIG. 4A is a block diagram showing in detail the construction of a density sensor appearing in FIG. 1.
Figure 7:
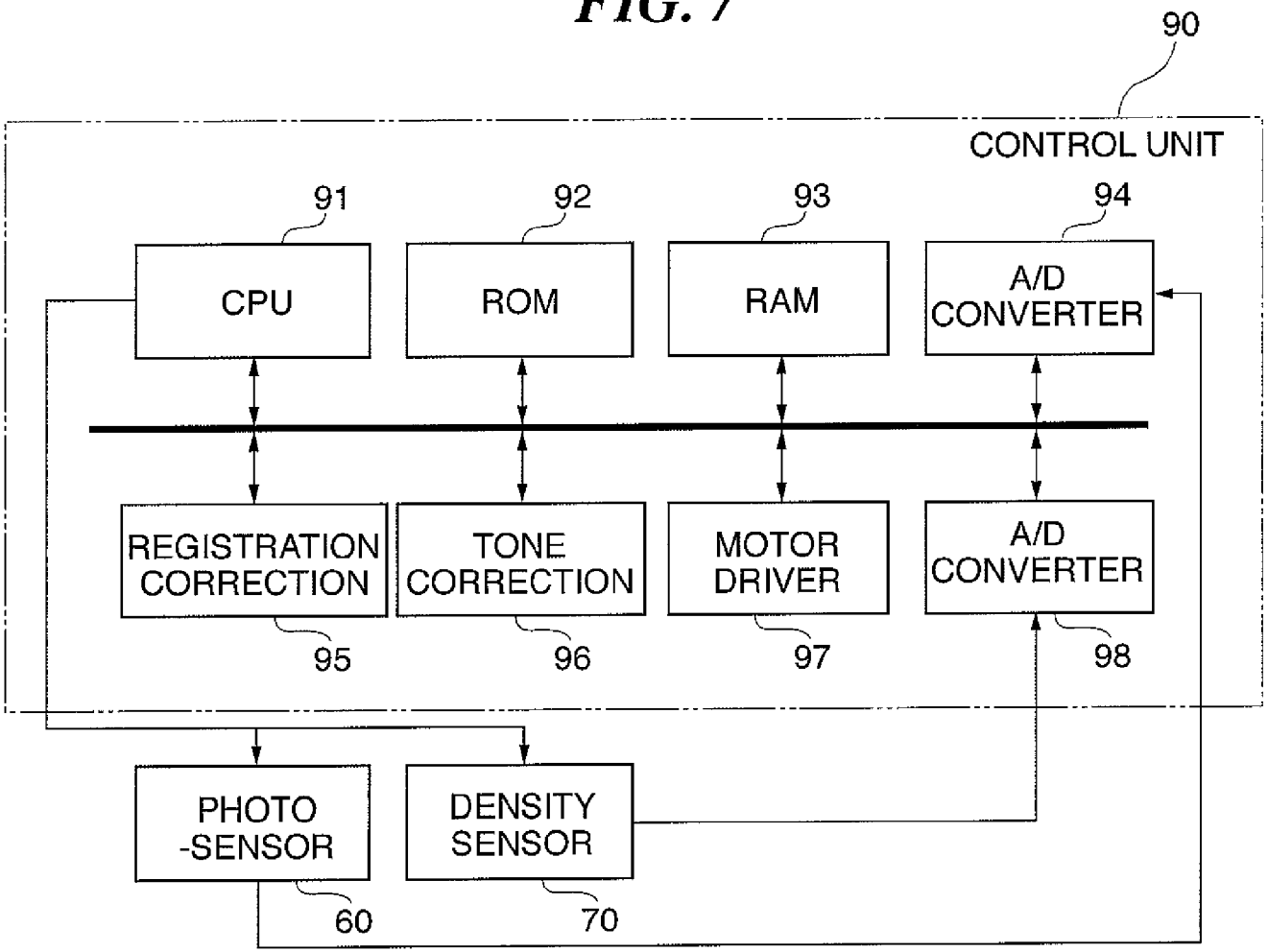
FIG. 7 is a block diagram showing in detail the construction of a control unit appearing in FIG. 1.

As shown in FIG. 1, the image output section 1P is comprised of an image forming section 10, a sheet feed unit 20, an intermediate transfer unit 30, a fixing unit 40, a cleaning unit 50, photo-sensors 60 (60*a* and 60*b*) in FIG. 2, a density sensor 70 in FIG. 4A, and a control unit 90 in FIG. 7.

A detailed description will now be given of the units.

The image forming section 10 is comprised of, for example, four in-line image forming stations 10*a*, 10*b*, 10*c*, and 10*d* which are identical in construction and arranged parallel to one another. Photosensitive drums 11*a*, 11*b*, 11*c*, 11*d* which are first image support members provided in the respective image forming stations 10*a* to 10*d* are rotatively driven in directions indicated by arrows A in FIG. 1.

Primary electrifiers 12*a*, 12*b*, 12*c*, and 12*d*, optical systems 13*a*, 13*b*, 13*c*, and 13*d*, reflection mirrors 16*a*, 16*b*, 16*c*, and 16*d*, developing devices 14*a*, 14*b*, 14*c*, and 14*d*, and cleaning devices 15*a*, 15*b*, 15*c*, and 15*d* are arranged around the perimeters of the respective photosensitive drums 11*a* to 11*d* and in the directions of rotations of the photosensitive drums 11*a* to 11*d*. The optical systems 13*a* to 13*d* function as light-exposure sections for exposing the respective photosensitive drums 11*a* to 11*d* to light. The developing units 14*a* to 14*d* store yellow (Y), cyan (C), magenta (M), and black (Bk) toners (developing agents), respectively.

The primary electrifiers 12*a* to 12*d* add charge to surfaces of the respective photosensitive drums 11*a* to 11*d* in such a manner that the amount of charge on each of the photosensitive drums 11*a* to 11*d* is uniform. The optical systems 13*a* to 13*d* expose the respective photosensitive drums 11*a* to 11*d* to light via the respective reflection mirrors 16*a* to 16*d* by, for example, laser beams modulated according to an image signal from the image reading section 1R. As a result, electrostatic latent images are formed on the respective photosensitive drums 11*a* to 11*d*.

The developing devices 14*a* to 14*d* visualize (develop) the respective electrostatic latent images. In primary transfer areas Td, Tc, Tb, and Ta, the visible images obtained by the visualization are sequentially transferred onto an intermediate transfer belt 31 which is a belt-like intermediate transfer member. The intermediate transfer belt 31 is one of component elements constituting an intermediate transfer unit 30 and functions as a second image support member. The intermediate transfer unit 30 will be described later in detail. It should be noted that the intermediate transfer belt 31 has a gloss which is dependent on the refractive index peculiar to the material of a primary coating and the optical reflectivity varying according to the state of the surface of the primary coating.

The cleaning devices 15*a* to 15*d* scrape off toners that remain on the respective photosensitive drums 11*a* to 11*d* without being transferred onto the intermediate transfer belt 31.

By the above described process, images are sequentially formed using toners of respective colors.

The sheet feed unit 20 is comprised of cassettes 21*a* and 21*b* and a manual feed tray 27 (hereinafter referred to as "sheet feed trays") for storing recording materials P which are third image support members, pickup rollers 22*a*, 22*b*, and 26, a sheet feed guide 24, a pair of sheet feed rollers 23, and resist rollers 25*a* and 25*b*. The pickup rollers 22*a*, 22*b*, and 26 feed recording materials P one by one from the three sheet feed trays. The sheet feed rollers 23 convey recording materials P fed from any of the pickup rollers 22*a*, 22*b*, and 26. The resist rollers 25*a* and 25*b* feed recording materials P toward a secondary transfer area Te in synchronization with timing in which images are formed by the image forming stations 10*a* to 10*d*.

A detailed description will now be given of the intermediate transfer unit 30.

The intermediate transfer belt 31 has an end thereof tensely wound up between a driving roller 32, a driven roller 33, and an opposed roller 34. The driving roller 32 is a winding roller that transfers drive power to the intermediate transfer belt 31. The driven roller 33 is a tension roller that is urged by a spring, not shown, to apply suitable tension to the intermediate transfer belt 31. The opposed roller 34 is disposed in opposed relation to the secondary transfer area Te with the intermediate transfer belt 31 interposed therebetween. Examples of the material of the intermediate transfer belt 31 include PET (polyethylene terephthalate) and PVdF (polyvinylidene fluoride). The driving roller 32 is rotatively driven in a direction indicated by the arrow B in FIG. 1 by a pulse motor, not shown. The driven roller 33 follows the rotation of the intermediate transfer belt 31.

A primary transfer plane T is formed between the driving roller 32 and the driven roller 33 and faces the photosensitive drums 11*a* to 11*d*. Thus, the primary transfer areas Ta to Td are located on the primary transfer plane T. The photo-sensors 60*a* and 60*b* and the density sensor 70 are provided on part f the primary transfer plane T between the photosensitive drum 11*a* and the driving roller 32 (see FIGS. 3 and 6).

Primary transfer electrifiers 35*a*, 35*b*, 35*c*, and 35*d* disposed in opposed relation to the respective photosensitive drums 11*a* to 11*d* with the intermediate transfer belt 31 interposed therebetween are disposed in the primary transfer areas Ta to Td. On the other hand, a second transfer roller 36 is disposed in opposed relation to the opposed roller 34 with the intermediate transfer belt 31 interposed therebetween. The secondary transfer area Te is comprised of a part nipped between the secondary transfer roller 36 and the intermediate transfer belt 31. The secondary transfer roller 36 is pressed against the intermediate transfer belt 31 by applying suitable pressure.

The cleaning unit 50 is disposed downstream of the secondary transfer area Te of the intermediate transfer belt 31. The cleaning unit 50, which is comprised of a cleaning blade 51 for removing toners on the intermediate transfer belt 31 and a waste toner box 52 for storing waste toners, cleans a surface of the intermediate transfer belt 31 on which images are formed.

The fixing unit 40 is comprised of a fixing roller 41*a* having a heat source such as a halogen heater incorporated therein, a fixing roller 41*b* which is pressed against the fixing roller 41*a* by applying pressure, and a guide 43 for guiding recording materials P to a part nipped between the pair of fixing rollers (i.e. fixing rollers 41*a* and 41*b*). The fixing unit 40 is further comprised of fixing heat-insulating covers 46 and 47 for trapping in the heat of the fixing unit 40, and a pair of inner sheet discharge rollers 44 and a pair of outer sheet discharge rollers 45 for guiding recording materials P discharged from the pair of fixing rollers to the outside of the copying machine 100. The recording materials P guided to the outside of the copying machine 100 are stacked on a discharged sheet tray 48.

FIG. 2 is a block diagram showing in detail the construction of the photo-sensors 60 appearing in FIG. 1.

Figure 3:
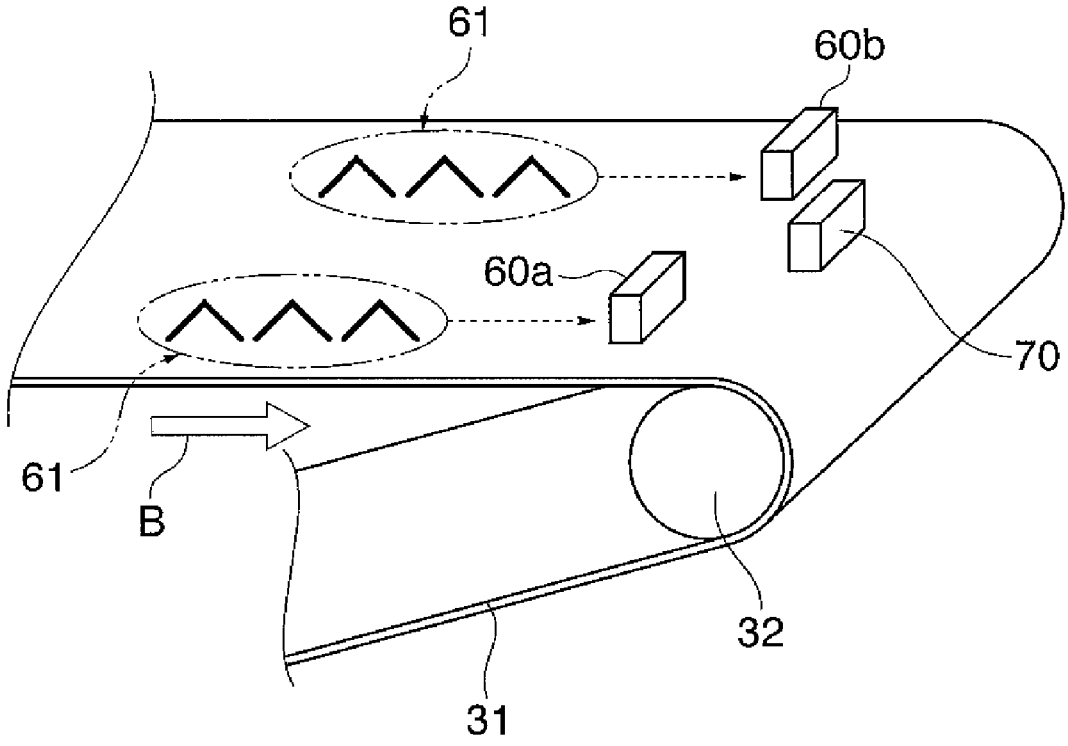
FIG. 3 is a diagram schematically showing

As shown in FIGS. 2 and 3, each of the photo-sensors 60*a* and 60*b* constituting the photo-sensors 60 includes a holder that holds an LED 65*a* which is a light-emitting device and a phototransistor (PT) 65*b* which is a photoreceptor. The PT 65*b* is connected to the control unit 90 via a light-receiving circuit (see FIG. 4B). The LED 65*a* radiates the intermediate transfer belt 31 with infrared light, for example, and the PT 65*b* receives the reflected light. It should be noted that the photoreceptor may alternatively be a cadmium sulfide photoconductor (CdS), for example.

FIG. 3 is a diagram schematically showing pattern images which are detected by the photo-sensors 60 appearing in FIG. 2.

As shown in FIG. 3, toner images 61 (hereinafter referred to as "pattern images") with a predetermined pattern for registration correction which are used to correct for a color shift occurring in superimposing Y, C, M, and Bk images upon one another are formed on the intermediate transfer belt 31. It should be noted that the material of the intermediate transfer belt 31 has a higher reflectivity with respect to infrared light from the LED 65*a* as compared with the pattern images 61. The photo-sensors 60*a* and 60*b* read the pattern images 61 using such a difference in reflectivity. The reading result is input as pattern signals indicative of the pattern images 61 to the control unit 90 via the above-mentioned light-receiving circuit.

FIG. 4A is a block diagram showing in detail the construction of the density sensor 70 appearing in FIG. 1.

As shown in FIG. 4A, the density sensor 70 is identical in construction with the photo-sensors 60*a* and 60*b*. Specifically, the density sensor 70 is comprised of an LED 75*a* which is a light-emitting device, and a phototransistor (PT) 75*b* which is a photoreceptor. The PT 75*b* is connected to the control unit 90 via a light-receiving circuit 80. It should be noted that the photoreceptor may alternatively be a cadmium sulfide photoconductor (CdS), for example.

Density sensors are broadly divided into varieties of the type that reads diffusely-reflected components of reflected light and varieties of the type that reads regularly-reflected components of reflected light. There are also density sensors of the type that reads both diffusely-reflected components and regularly-reflected components.

In the present embodiment, the density sensor 70 is of the type which reads regularly-reflected components of reflected light. As shown in FIG. 4A, the density sensor 70 of this type reads reflected light reflected in a direction symmetric to the irradiation angle of irradiating light with respect to the normal to the surface of the intermediate transfer belt 31 which is a primary coating. That is, the density sensor 70 mainly reads reflected light from the primary coating and additionally reads reflected light from toners of images if the images are formed on the primary coating. Thus, the density sensor 70 can detect the density corresponding to the intensity of read reflected light (reflection level) irrespective of the color of the primary coating and the color of toner.

Figure 4B:
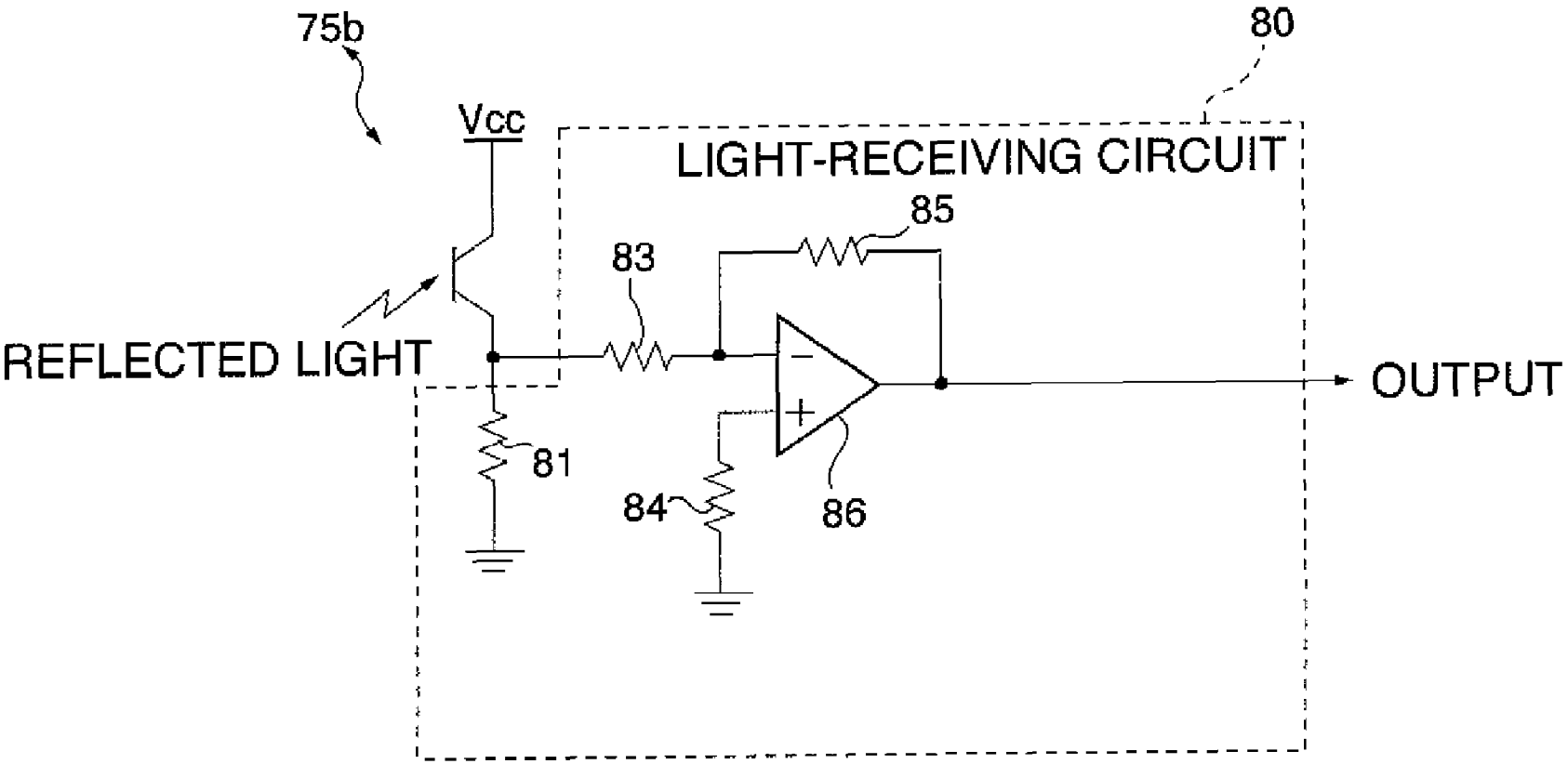
FIG. 4B is a block diagram showing in detail the construction of a light-receiving circuit appearing in FIG. 4A.

FIG. 4B is a block diagram showing in detail the construction of the light-receiving circuit 80 appearing in FIG. 4A. It should be noted that the light-receiving circuit appearing in FIG. 2 is identical in construction with the light-receiving circuit 80 appearing in FIG. 4A.

As shown in FIG. 4B, the light-receiving circuit 80 of the density sensor 70 causes the PT 75*b* to receive reflected light of light radiated from the LED 75*a* toward the intermediate transfer belt 31 and a patch image 71, which is formed on the intermediate transfer belt 31 so as to carry out image adjustment as described later, and converts the reflection level of the received reflected light into an electric signal.

Specifically, the light-receiving circuit 80 is comprised of a resistor 81 that converts photoelectric current obtained as a result of light reception by the PT 75*b* into voltage, and resistors 83, 84, and 85 and a sample-hold circuit (not shown).

Figure 5A:
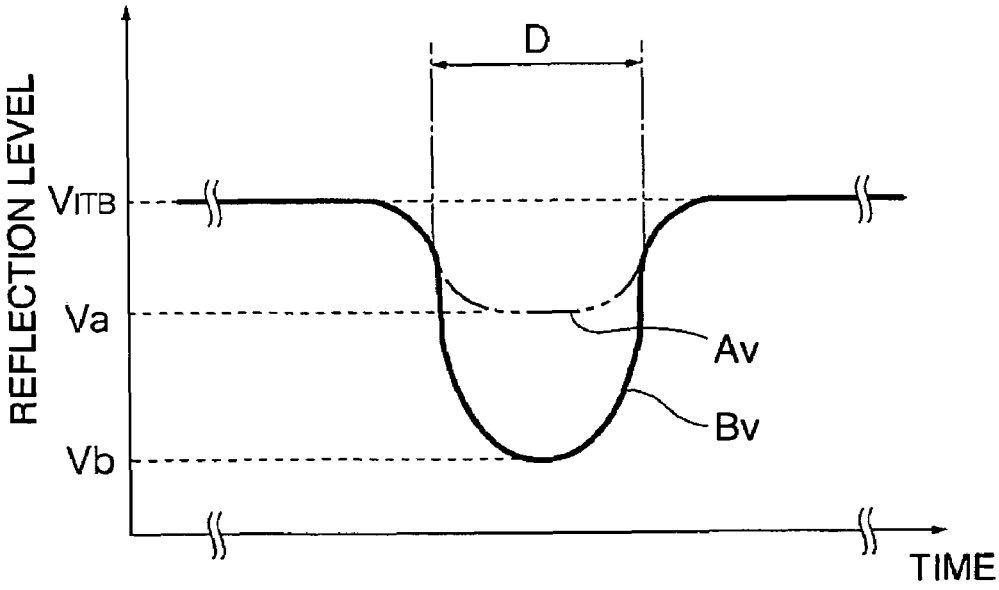
FIG. 5A is a view useful in explaining the reflection level of reflected light received by the density sensor in FIG. 4A.
Figure 5B:
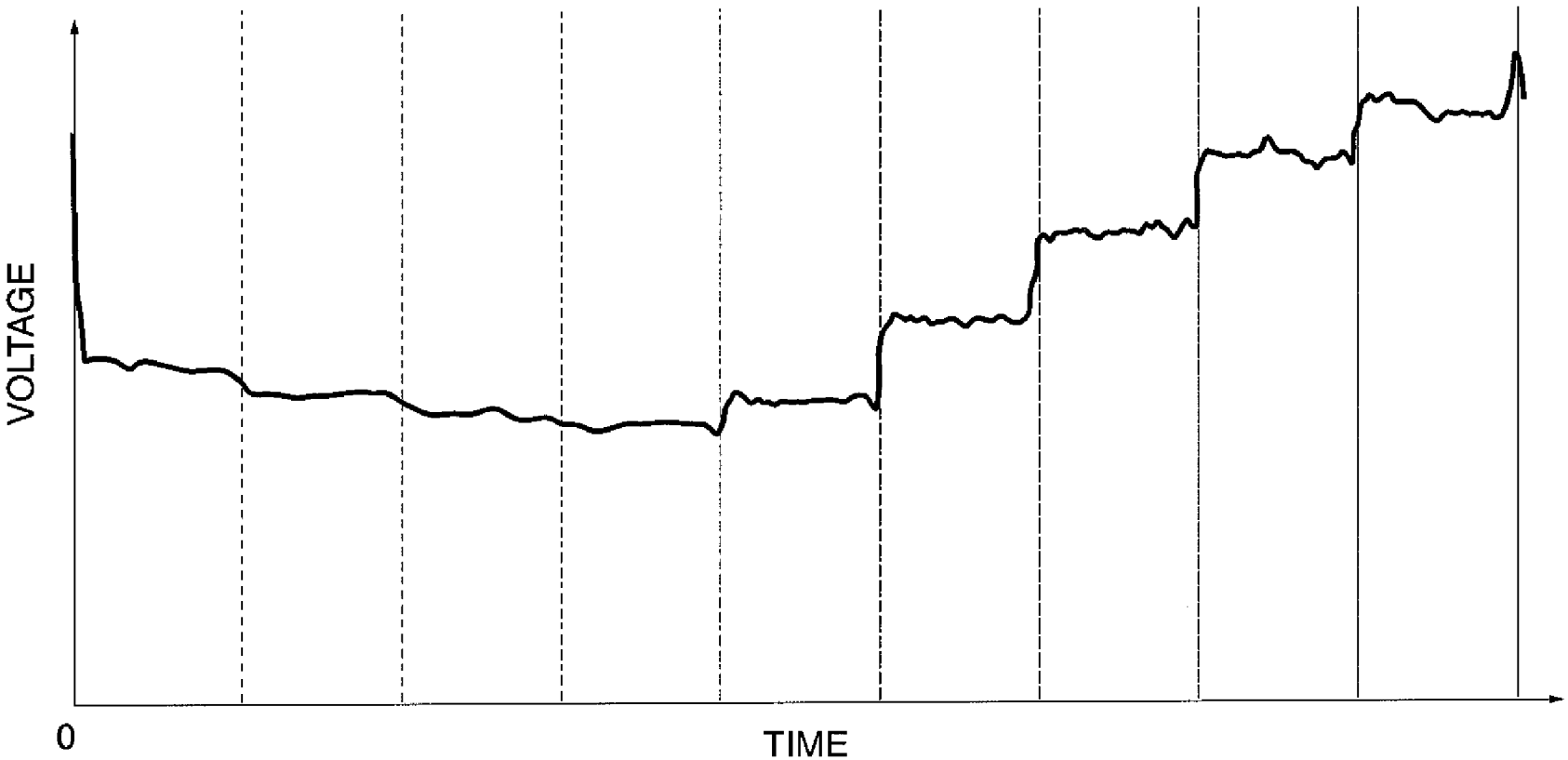
FIG. 5B is a view useful in explaining the reflection level of reflected light received from a patch image with nine tones by the density sensor.

FIG. 5A is a view useful in explaining the reflection level of reflected light received by the density sensor 70 in FIG. 4A. FIG. 5B is a view useful in explaining the reflection level of reflected light received from a patch image with nine tones by the density sensor 70. In FIGS. 5A and 5B, the ordinate axis indicates the reflection level or the voltage value, and the abscissa axis indicates time, i.e. changes in detected positions on the intermediate transfer belt 31.

FIG. 5A shows changes in the reflection level of reflected light detected by the density sensor 70 when the detected position shifts as follows: the surface of the intermediate transfer belt 31→the patch image 71→the surface of the intermediate transfer belt 31.

Since the intermediate transfer belt 31 has a gloss, the amount of reflected light obtained is large and the reflection level is high when the density sensor 70 detects areas except for the patch image 71 formed on the intermediate transfer belt 31, i.e. the surface of the intermediate transfer belt 31. The reflection level is expressed by $V_{ITB}$. Accordingly, a large amount of photoelectric current passes through the PT 75*b*.

On the other hand, in the case where the patch image 71 is formed on the surface of the intermediate transfer belt 31, the reflection level of reflected light is reduced since the surface of the intermediate transfer belt 31 which is the primary coating is covered with toners of the patch image 71. For this reason, when the density sensor 70 detects the patch image 71, the amount of reflected light is smaller than in the case where the surface of the intermediate transfer belt 31 is detected, and the reflection level is reduced to $V_a$ as indicated by the alternate long and short dashed lines $A_v$ in FIG. 5A. Accordingly, a smaller amount of photoelectric current passes through the PT 75*b* than in the case where the surface of the intermediate transfer belt 31 is detected. As the amount of toners of the patch image 71 increases, the amount of reflected light from the patch image 71 further decreases, and the reflection level is further reduced to $V_b$ as indicated by the solid line $B_v$ in FIG. 5A.

Referring to FIG. 5A, the magnitude relation between the reflection levels, $V_a$, and $V_b$ is expressed by $V_{ITB}>V_a>V_b$. $V_{ITB}$ represents the reflection level of reflected light from the intermediate transfer belt 31. $V_a$ represents the reflection level of reflected light from the part of the patch image 71 with a low density formed on the intermediate transfer belt 31. $V_b$ represents the reflection level of reflected light from part of the patch image 71 with a high density formed on the intermediate transfer belt 31.

Referring to FIG. 5B, as the patch density decreases (with the passage of time), the reflection level of reflected light received from a patch image with nine tones, i.e. the voltage value increases, and the range of fluctuation (S/N ratio) of an associated signal increases. That is, the S/N ratio is unfavorable (low) when the patch density is low, and on the other hand, the S/N ratio is high when the patch density is favorable (high). This is because, as the patch density decreases, the patch density becomes more susceptible to reflected light from the intermediate transfer belt 31 underlying the patch image 71 and reflected light from the intermediate transfer belt 31 around the patch image 71. Thus, in the case where the patch density is obtained by calculating a difference between the reflection level $V_{ITB}$ and the reflection level $V_a$, the accuracy decreases as the difference decreases. On the other hand, if the patch density is high, the patch density is less lightly to be affected by reflected light from the intermediate transfer belt 31 underlying the patch image 71 and reflected light from the intermediate transfer belt 31 around the patch image 71.

Thus, to improve the accuracy of reading the patch density of the patch image 71 with a low patch density, enable accurate density correction, and reduce the processing time required for correcting processing where the densities of the patch image 71 formed on the intermediate transfer belt 31 having a high reflection level are detected, an approach described below may be taken.

Firstly, the number of times the reflection level $V_a$ is read is set to a large value, the time interval at which the reflection level $V_a$ is read is set to a small value, or the total time interval during which the reflection level $V_a$ is read is set to a large value. Secondly, the number of times the reflection level $V_b$ is read is set to a small value, the time interval at which the reflection level $V_b$ is read is set to a large value, or the total time interval during which the reflection level $V_b$ is read is set to a small value. Thirdly, the size (in the direction in which the image support member is moved of each patch with the reflection level $V_a$ is formed to be large, and the area of each patch with the reflection level $V_b$ is formed to be small.

The reflection level is read as an output of the PT 75*b* by sampling the output of the PT 75*b* when the LED 75*a* is lit up within an area of the patch image. As another method, the reflection level is read as the output of the PT 75*b* by sampling the output of the PT 75*b* depending on the LED 75*a* being lit up in a case where the LED 75*a* is lit up intermittently within the area of the patch image (repeatedly lit up or turned out).

In other words, the number of times the reflection level is read corresponds to the number of times the output of the PT 75*b* is sampled, and the time interval at which the reflection level is read corresponds to the time interval at which the output of the PT 75*b* is sampled. Further, the total time interval during which the reflection level is read corresponds to the time interval during which the output of the PT 75*b* is sampled.

Figure 6:
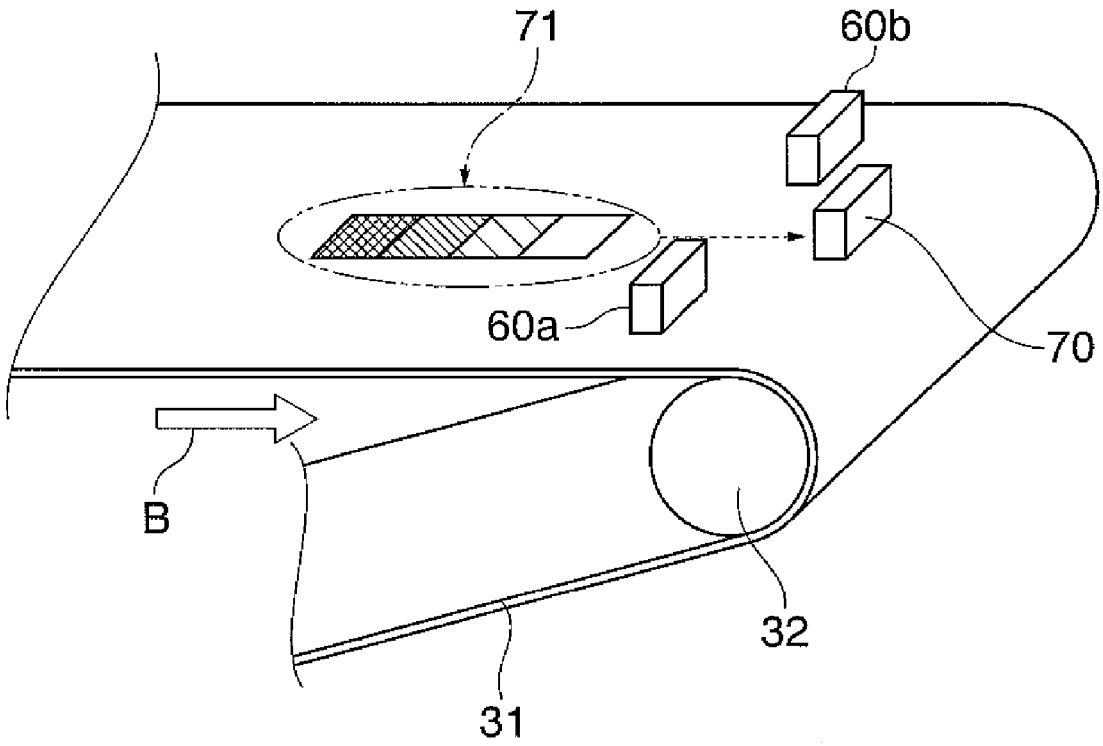
FIG. 6 is a diagram schematically showing a patch image which is detected by the density sensor in FIG. 4A.

FIG. 6 is a diagram schematically showing a patch image detected by the density sensor 70 in FIG. 4A.

As shown in FIG. 6, the patch image 71 having different toner densities (patch densities) of respective colors is formed on the intermediate transfer belt 31 so as to carry out image adjustment. The density sensor 70 reads the patch image 71. The reading result is input as a density signal indicative of measured toner densities to the control unit 90 via the light-receiving circuit 80.

FIG. 7 is a block diagram showing in detail the construction of the control unit 90 appearing in FIG. 1.

As shown in FIG. 7, the control unit 90 is comprised of a CPU 91, a ROM 92, a RAM 93, A/D converters 94 and 98, a registration correction circuit 95 for image adjustment, a tone correction circuit 96 for image adjustment, a motor driver 97, and so forth and controls the above-mentioned units. The ROM 92 stores programs corresponding to flow charts of FIGS. 9 and 11, described later.

The pattern images 61 read by the photo-sensors 60 are input as pattern data to the CPU 91 via the A/D converter 94. The CPU 91 calculates the amount of registration error based on the pattern data and causes the registration correction circuit 95 to carry out registration correction. In the registration correction, an image signal of an image to be formed is electrically corrected and/or, for example, the optical path length is changed by driving the reflection mirrors 16*a* to 16*d* disposed in optical paths of laser beams according to the detected amount of registration error.

The patch image 71 read by the PT 75*b* of the density sensor 70 is input as density data to the CPU 91 via the light-receiving circuit 80 and the A/D converter 98. The CPU 91 causes the tone correction circuit 96 to carry out tone correction based on the density data. In the tone correction, toner densities are corrected based on the density data before an image forming process is carried out, so that toner densities can be maintained constant and uniform gradation can be maintained. The CPU 91 controls the timing in which reading of each patch is started to predetermined timing managed in accordance with a control program. Also, from the time at which reading (or sampling) of each patch is started, the CPU 91 controls and counts the number of times the output from the density sensor 70 is read according to patch densities or sizes (lengths in the direction in which the image support member is moved of patches constituting the patch image 71, which are stored in the ROM 92. The time interval at which the output from the density sensor 70 is read may be used instead of the number of readings. In an alternative form, the total time interval during which the output from the PT 75*b* is read may be changed. It should be noted that the CPU 91 may be provided with the capabilities of the registration correction circuit 85 and the tone correction circuit 96.

The registration correction and the tone correction described above are carried out before, for example, an image forming process, described later, is carried out. These corrections may be carried out at a predetermined time, for example, when power supply to the copying apparatus 100 is turned on, the copying machine 100 is restored from a shutdown state, when a predetermined time period has elapsed after a predetermined number of prints are made, or when a change in the environment in which the copying apparatus 100 is used is detected.

A description will now be given of an image forming process carried out by the copying machine 100 in FIG. 1.

When an image forming process start signal is given off by an operating section, not shown, the CPU 91 starts feeding sheets from a sheet feed tray suitable for a selected sheet size or the like, for example the upper-row sheet feed tray (cassette 21*a*).

First, the pickup roller 22*a* feeds recording materials P one by one from the cassette 21*a*. The recording material P is guided on a conveying path of the sheet feed guide 24 by the sheet feed rollers 23 to reach the resist rollers 25*a* and 25*b*. When the recording material P reaches the resist rollers 25*a* and 25*b*, the resist rollers 25*a* and 25*b* are standing still, so that the leading end of the recording material P abuts against the nipped part. Thereafter, the timing in which the resist rollers 25*a* and 25*b* start rotating is set so that the recording material P conveyed from the resist rollers 25*a* and 25*b* and toner images primarily transferred onto the intermediate transfer belt 31 by the image forming stations 10*a* to 10*d* are consistent with each other in the secondary transfer area Te.

On the other hand, in the image forming section 10, a toner image formed on the photosensitive drum 11*d* disposed upstream is primarily transferred onto the intermediate transfer belt 31 in the primary transfer area Td by the primary transfer electrifier 35*d*. The primarily transferred toner image is conveyed to the next primary transfer area Tc. In the primary transfer area Tc, image formation is carried out after a delay corresponding to the interval during which the toner image is transferred between the image forming stations 10*a* to 10*d*, and the next toner image is transferred onto the previous toner image in such a manner that they are in registration (aligned). The same processing is repeatedly carried out in the primary transfer areas Tb and Ta as well, and as a result, toner images of four colors are primarily transferred onto the intermediate transfer belt 31.

After that, the recording material P enters the secondary transfer area Te and comes into contact with the intermediate transfer belt 31. High voltage is applied to the secondary transfer roller 36 in synchronization with timing in which the recording material P passes the secondary transfer roller 36. As a consequence, the toner images of four colors formed on the intermediate transfer belt 31 by the above described process are collectively transferred onto the surface of the recording material P. The recording material P is then guided to the nipped part between the fixing rollers by the conveying guide 43. The toner images are fixed on the surface of the recording material P by heat from the fixing rollers and pressure from the nipped part. The recording material P is then conveyed by the inner and outer sheet discharge rollers 44 and 45 and placed on the discharged sheet tray 48.

A detailed description will now be given of tone correction as image adjustment which is carried out in the present embodiment. It should be noted that in the present embodiment, the registration correction is carried out before the tone correction is carried out.

Figure 8:
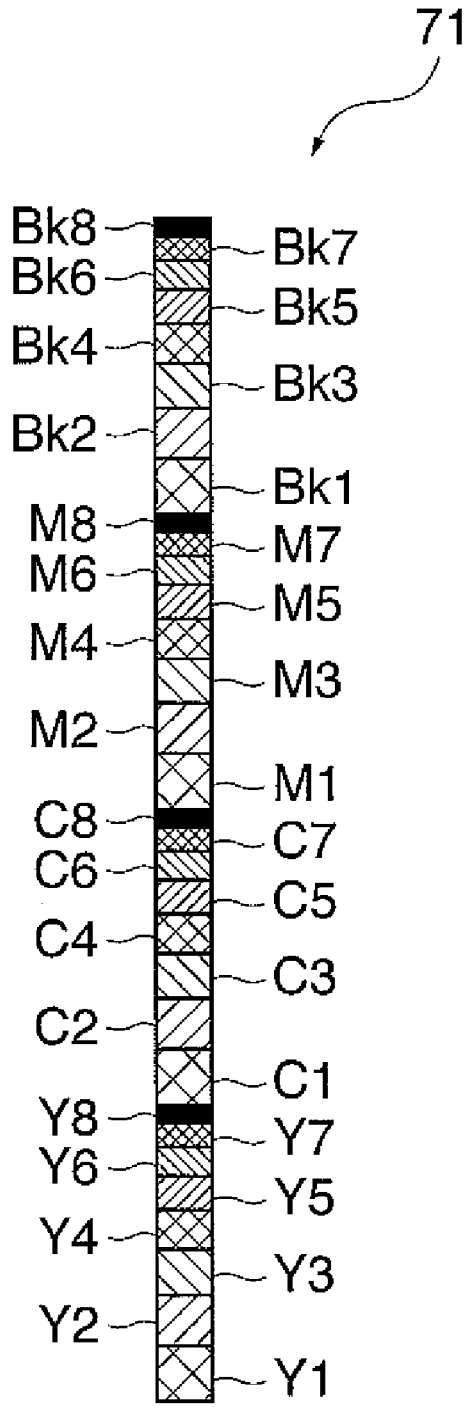
FIG. 8 is a view useful in explaining the patch image in FIG. 6.

FIG. 8 is a view useful in explaining in detail the patch image 71 appearing in FIG. 6.

As shown in FIG. 8, the patch image 71 is comprised of eight patches Y1 to Y8 for yellow tone correction, eight patches C1 to C8 for cyan tone correction, eight patches M1 to M8 for magenta tone correction, eight patches Bk1 to Bk8 for black tone correction. All the patches have the same width. The eight patches of each color are set to have different tones so as to make it possible to correct tone correction curves.

As the patch density decreases, the patches become more susceptible to the optical reflectivity of the intermediate transfer belt 31 which is the primary coating, and as the patch density increases, the patches become less susceptible to the optical reflectivity of the intermediate transfer belt 31. Thus, considering the effects of the optical reflectivity of the intermediate transfer belt 31, the patch image 71 is formed in such a manner that the dimension (length) thereof of each patch in the direction in which the intermediate transfer belt 31 is moved (the direction indicated by the arrow B in FIG. 6) decreases as the patch density thereof increases. Specifically, the lengths of the patches Y1 to Y8 for yellow tone correction are set to 20 mm, 18 mm, 16 mm, 14 mm, 12 mm, 10 mm, 8 mm, and 6 mm, respectively, and stored in the ROM 92. The same goes for the other colors.

Figure 9:
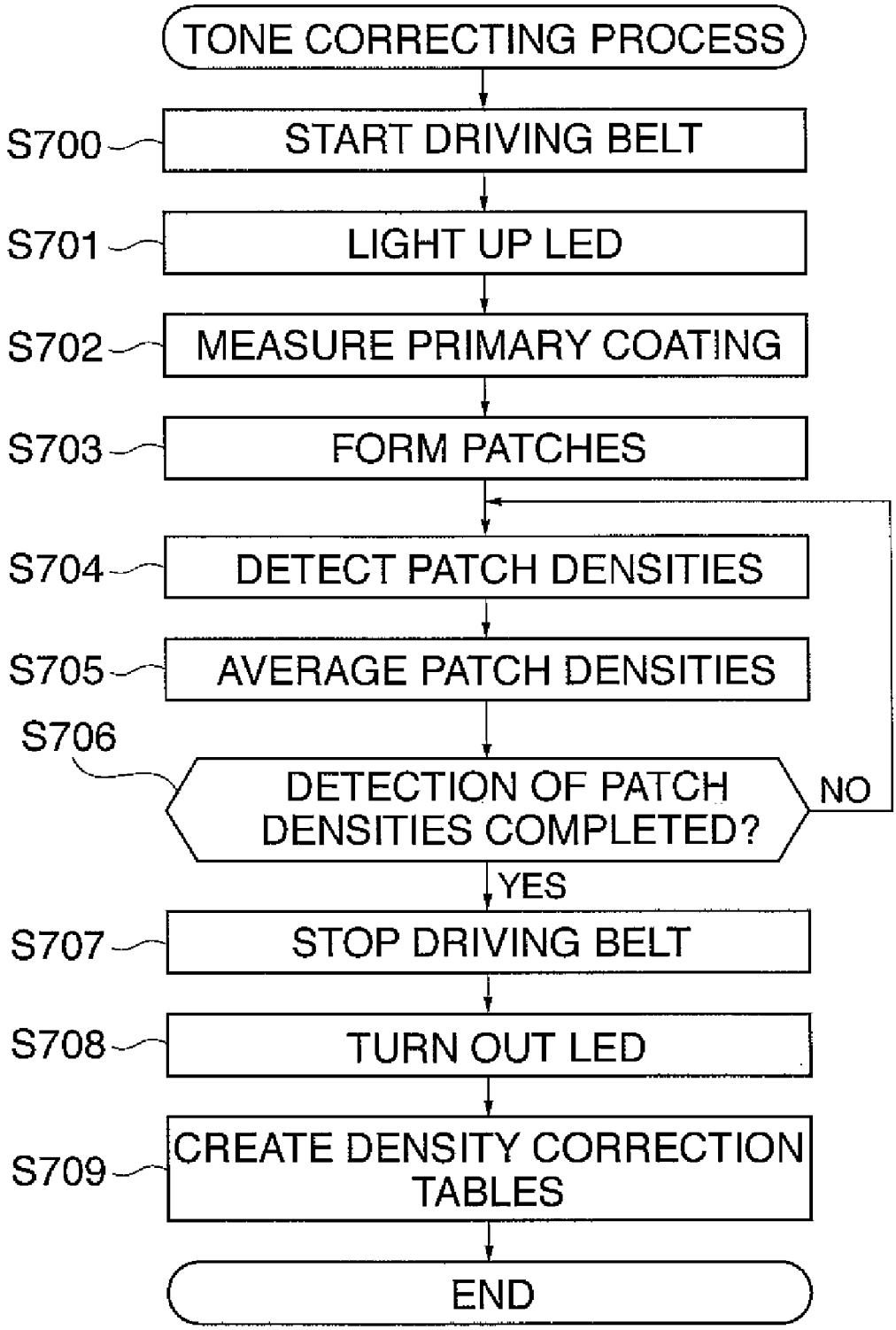
FIG. 9 is a flow chart showing a tone correcting process carried out by the image forming apparatus in FIG. 1.

FIG. 9 is a flow chart showing a tone correcting process carried out by the copying machine 100 in FIG. 1.

As shown in FIG. 9, upon starting the tone correcting process, first, the CPU 91 starts driving the intermediate transfer belt 31 (step S700) and lights up the LED 75*a* of the density sensor 70 (step S701). The PT 75*b* of the density sensor 70 then reads the intermediate transfer belt 31 with no toner image formed thereon. The CPU 91 reads the output from the PT 75*b* at regular time intervals via the PT 75*b*, light-receiving 80, and A/D converter 98 and averages them into blank data (step S702). The blank data is used to correct patch density readings, described later.

The path image 71 in FIG. 8 is then formed on the intermediate transfer belt 31 (step S703). The patches of the patch image 71 are formed to have lengths corresponding to toner densities as described above.

The CPU 91 then reads the output from the PT 75*b* with respect to the respective patches the number of times corresponding to the number of readings, described later. Specifically, the CPU 91 starts reading each patch in predetermined timing which is under management of a control program and reads the output from the PT 75*b* the number of times corresponding to the number of readings associated with each patch, which is stored in the ROM 92. The time at which reading of each patch is started can be determined by measuring elapsed time before each patch reaches the density sensor 70 from the starting point at which each patch is formed on each of the photosensitive drum 11*a* to 11*d*. Considering the effects of the optical reflectivity of the intermediate transfer belt 31 as mentioned above, the number of readings is set to decrease as the toner density increases. Specifically, the numbers of readings for the patches Y1 to Y8 for yellow tone correction is set to 10, 9, 8, 7, 6, 5, 4, and 3, respectively, and stored in the ROM 92. The same goes for the other colors (step S704). The CPU 91 then acquires patch densities by reading the output from the PT 75*b* a plurality of times via the PT 75*b*, light-receiving circuit 80, and A/D converter 98, averages them, and obtains a difference between the averaging result and the above-mentioned blank data to obtain density data on each patch (step S705).

The CPU 91 then determines whether or not all the patches constituting the patch image 71 have been read the associated number of times, i.e. whether or not the detection of the patch densities has been completed (step S706). If the detection has not yet been completed, the processing in the steps S704 to S706 is repeatedly carried out, and if the detection has been completed, the process proceeds to a step S707. Specifically, the intermediate transfer belt 31 is stopped (step S707), and the LED 75*a* is turned out (step S708).

After that, density correction tables are created and tone correction curves are corrected based on the stored density data on the patches (step S709), followed by termination of the tone correcting process. The density correction tables and the tone correction curves thus obtained are used for image formation afterward.

Referring to the patch image 71 in FIG. 8 and the tone correcting process in FIG. 9, the lengths of patches are dependent on patch densities (shade or gradation) (FIG. 8, step S703), and the output from the density sensor 70 is read the numbers of times corresponding to the patch densities of the respective patches (step S704). In other words, in the above described embodiment, the length of each patch and the number of times each patch is read can be suitably controlled according to patch density. Thus, in the above described embodiment, toner consumption can be reduced while curbing the rise in running cost, and also, downtime caused by tone correction which is automatically carried out can be reduced to improve the image formation capability of the copying machine 100 to a satisfactory degree. In addition, the copying machine 100 can offer color images with stable color tones using density correction tables and tone correction curves as in the conventional art.

Although in the above described embodiment, the patch image 71 is formed on an endless belt such as the intermediate transfer belt 31, the present invention is not limited to this, but the patch image 71 may be formed on an image support member such as the photosensitive drums 11*a* to 11*d* or a recording material P. In the case where the patch image 71 is formed on a recording material P, the density sensor 70 is disposed downstream of the secondary transfer roller 36 as viewed in the conveying direction (behind the fixing unit 40, for example).

Although in the above described embodiment, tone correction is carried out using the copying machine 100 in FIG. 1 after registration correction is carried out, registration correction and tone correction may be carried out at the same time in a variation of the above described embodiment. This variation will be described below.

Figure 10:
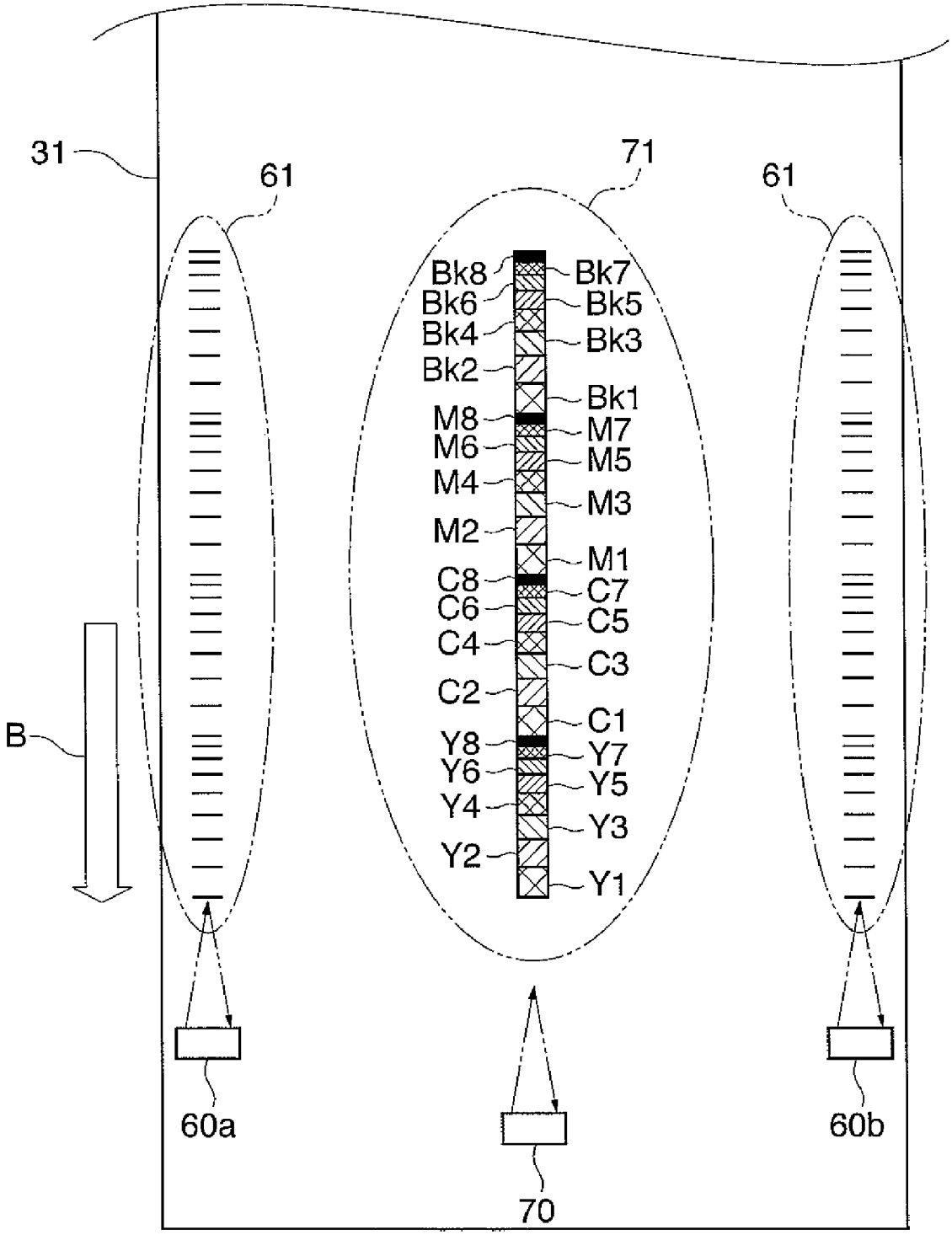
FIG. 10 is a view useful in explaining pattern images and a patch image formed on an intermediate transfer belt appearing in FIG. 1 according to a variation of the embodiment of the present invention.

FIG. 10 is a view useful in explaining pattern images 61 and a patch image 71 formed on the intermediate transfer belt 31 appearing in FIG. 1 according to the present variation.

As shown in FIG. 10, the pattern images 61 and the patch image 71 are formed at the same time on the intermediate transfer belt 31.

Specifically, first, as for patches of the patch image 71 for yellow tone correction, linear toner images constituting each of the pattern images 61 are formed at distances of 20 mm, 38 mm, 54 mm, 68 mm, 80 mm, 90 mm, and 98 mm from the reference position (0 mm) which is the leading end of a patch Y1. Next, eight linear toner images constituting each of the pattern images 61 for the other colors are formed as is the case with the patches for yellow tone correction, with reference positions set at intervals of 104 mm. At a position corresponding to the trailing end of the last patch, i.e. a patch Bk8 for black tone correction, a linear toner image is formed.

Referring to FIG. 10, 33 linear toner images constituting each of the pattern images 61 are indicative of the leading end positions of the 32 patches constituting the patch image 71 and the trailing end position of the patch image 71.

Figure 11:
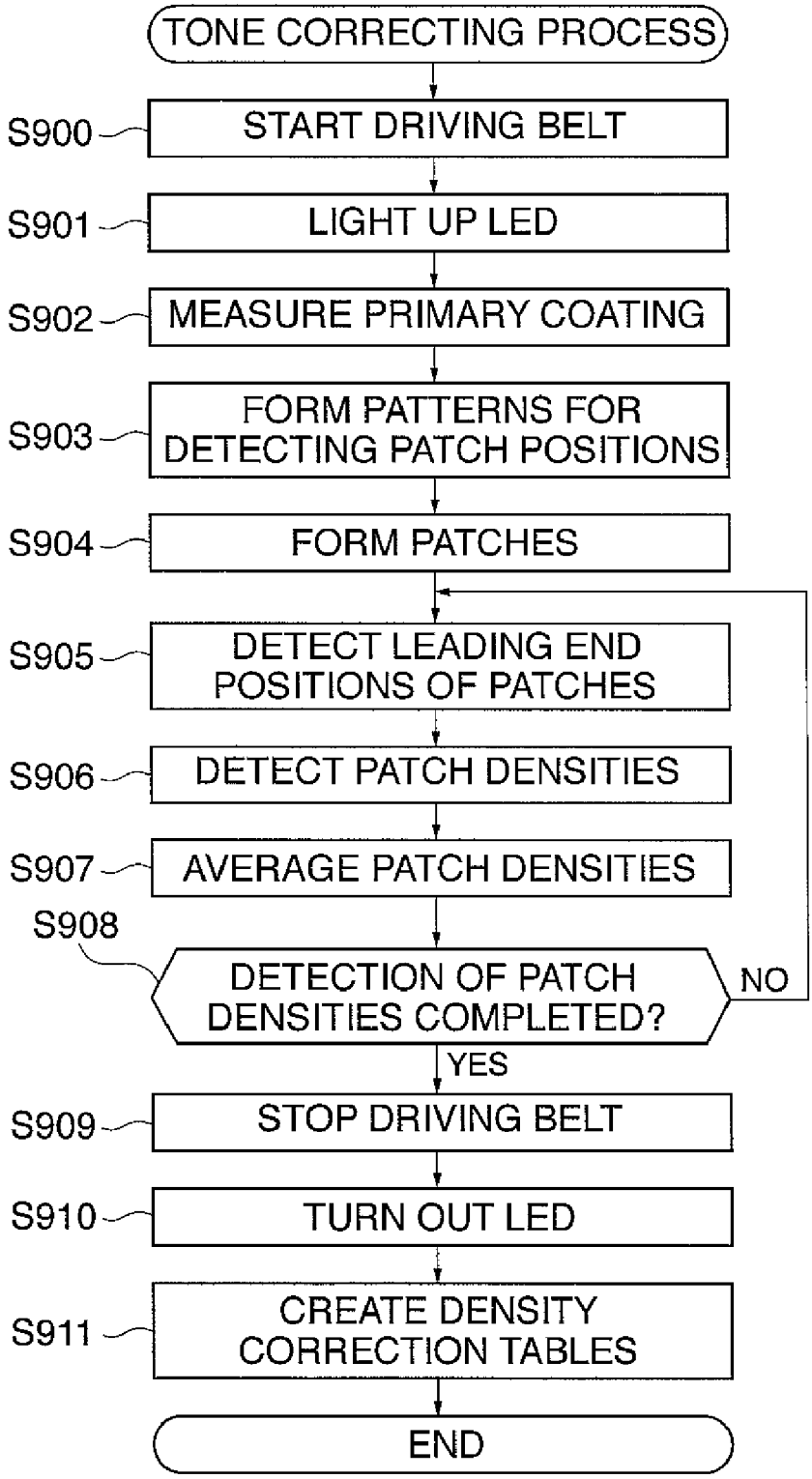
FIG. 11 is a flow chart showing a tone correcting process carried out using the pattern images and the patch image in FIG. 10.
Figure 12:
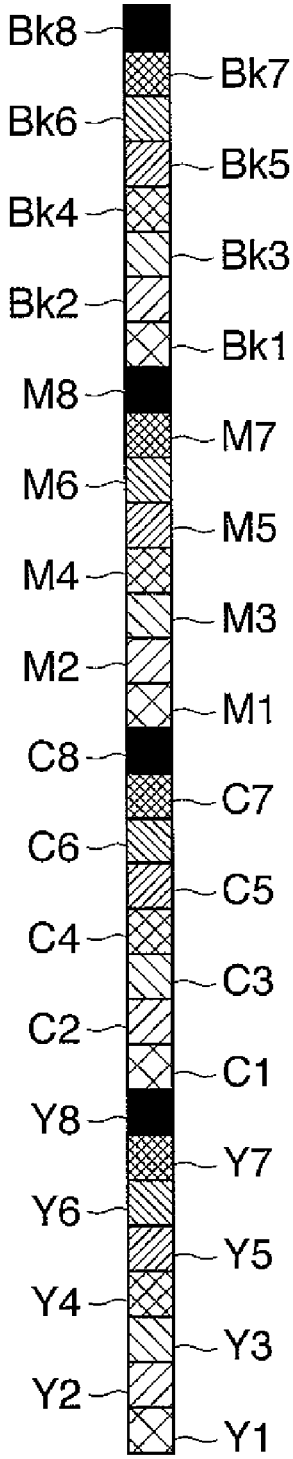
FIG. 12 PRIOR ART
FIG. 12 is a view useful in explaining a path image formed by a conventional image forming apparatus.

FIG. 11 is a flow chart showing a tone correcting process carried out using the pattern images 61 and the patch image 71 in FIG. 10.

The tone correcting process in FIG. 11 is partially identical with the tone correcting operation in FIGS. 7 and 9, and hence differences will mainly be described below.

As shown in FIG. 11, first, in steps S900 to S902, the tone correcting process is started to read the intermediate transfer belt 31 with no toner image formed thereon as in the steps S700 to S702 in FIG. 9.

Next, in steps S903 and S904, the pattern images 61 as well as the patch image 71 which is formed in the same manner as in the step S703 in FIG. 9 are formed on the intermediate transfer belt 31 as described above with reference to FIG. 10.

Next, in a step S905, the CPU 91 lights up the LEDs 65*a* and 75*a* of the photo-sensors 60 and the density sensor 70 to make the pattern images 61 and the patch image 71 readable. As a consequence, the PTs 65*b* of the photo-sensors 60 sequentially detect linear pattern images 61 indicative of the leading end positions of the respective patches constituting the patch image 71. The photo-sensors 60 input the timing at which they sequentially detect the pattern images 61 to the CPU 91. Based on the timing, the CPU 91 starts reading each patch of the patch image 71 upon the lapse of a predetermined time period and reads the output from the PT 75*b* the number of times corresponding to each patch. If the photo-sensors 60 and the density sensor 70 lie on the same line, the predetermined time period is substantially zero, and if the photo-sensors 60 and the density sensor 70 do not lie on the same line, the predetermined time period corresponds to the time it takes to move from the photo-sensors 60 to the density sensor 70. As a consequence, the CPU 91 starts reading each patch of the patch image 71 in synchronization with timing in which the pattern images 61 are detected and reads each patch the associated number of times (step S906). Thus, the timing in which reading of each patch by the density sensor 70 is started does not have to be managed by a control program unlike the step S704 in FIG. 9, and hence cost increase can be curbed. The number of times each patch is read is the same as that in the step S704 in FIG. 9.

Next, in steps S907 to S911, the same processing as in the steps S705 to S709 in FIG. 9 is carried out to create density correction tables and correct tone correction curves. After that, the tone correcting process is terminated.

According to the present variation, the same effects as those in the above described embodiment can be obtained. In the above described embodiment, the positions at which reading of patches by the density sensor 70 is started can be determined with high accuracy based on a plurality of linear toner images constituting the pattern images 61. Particularly when patches are very short, it is possible to prevent failure in reading patches due to errors in the positions at which reading of the patches by the density sensor 70 is started. This prevents degradation in the image formation capability of the copying machine 100. Further, since at least part of the pattern images 61 according to the present variation also function as the pattern images 61 intended for registration correction (see FIGS. 2 and 3), the rise in running cost can be curbed.

It should be noted that in the present variation, since the photo-sensors 60*a* and 60*b* are disposed upstream of the density sensor 70 as viewed in the reading direction, the pattern images 61 and the patch image 71 are formed at the same positions as viewed in the reading direction (see FIG. 10). The density sensor 70 and the patch image 71 may be arranged at any given positions insofar as the photo-sensors 60*a* and 60*b* can start reading before the density sensor 70 does.

Although in the above described embodiment and variation, the pattern images 61 are formed on both sides as viewed in the direction indicated by the arrow B on the surface of the intermediate transfer belt 31, but one pattern image 61 may be formed on only one side. Further, although in the above described embodiment and variation, the pattern images 61 and the patch image 71 are formed on an endless belt such as the intermediate transfer belt 31, the present invention is not limited to this, but they may be formed on image support members such as the photosensitive drums 11*a* to 11*d* or recording materials P being conveyed. In the case where the pattern images 61 and the patch image 71 are formed on recording materials P, the photo-sensors 60 and the density sensor 70 are disposed downstream of the secondary transfer roller 36 as viewed in the conveying direction.

As for the patch image 71, the size (width and length) and density of each patch and the number of times each patch is read may be set to any given values, and the settings may be changed according to toner colors. For example, the lengths of patches may have the same size irrespective of their patch densities, and in such a case, as the patch density increases, the time interval at which the patches are read is increased, so that the number of readings can be reduced.

Further, although in the above described embodiment and variation, the copying machine 100 carries out tone control using the patch image 71, the present invention is not limited to this, but the copying machine 100 may carry out not only tone control but also control to change image forming conditions such as the amount of light exposure and the developing bias.

Further, the above described embodiment and variation thereof may be applied to an image forming apparatus equipped with a photosensitive belt in place of an intermediate transfer belt and photosensitive drums, an image forming apparatus equipped with a single photosensitive drum, and an image forming apparatus using ink.

It is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and the storage medium in which the program code is stored constitute the present invention.

Examples of the storage medium for supplying the program code include a floppy (registered trademark) disk, a hard disk, a magneto-optical disk, a CD-ROM, a CD-R, a CD-RW, a DVD-ROM, a DVD-RAM, a DVD-RW, a DVD+

RW, a magnetic tape, a nonvolatile memory card, and a ROM. Alternatively, the program code may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed the embodiments. The scope of the following claims is to be accorded the broadest interpretation so as to encompass all such modifications and equivalent structures and functions.

This application claims the benefit of Japanese Patent Application No. 2005-355281, filed Dec. 8, 2006 which is hereby incorporated by reference herein in its entirety.

What is claimed is:

1. An image forming apparatus that carries out image formation, comprising:

an image forming device that forms adjustment images having different densities on an image support member having a higher optical reflectivity than an optical reflectivity of the adjustment images; and a reading device that reads the adjustment images, wherein an output from said reading device is read at a predetermined number of readings or time interval between readings based on the densities of the adjustment images susceptible to the optical reflectivity of the image support member.

2. An image forming apparatus according to claim 1, wherein the output from said reading device is read with the number of readings set to a large value or with the time interval between readings set to a small value when the densities of the adjustment images are susceptible to the optical reflectivity of the image support member, and with the number of readings set to a small value or with the time interval between readings set to a large value when the densities of the adjustment images are not susceptible to the optical reflectivity of the image support member.

3. An image forming apparatus according to claim 1, wherein the densities of the adjustment images susceptible to the optical reflectivity of the image support member are low, and the densities of the adjustment images less susceptible to the optical reflectivity of the image support member are high.

4. An image forming apparatus according to claim 1, wherein said image forming device decreases the adjustment images in size in a moving direction of the image support member decrease as the adjustment images increase in density.

5. An image forming apparatus according to claim 4, wherein the number of readings or the time interval between readings is set based on the sizes of the adjustment images.

6. An image forming apparatus according to claim 4, wherein said image forming device forms patterns indicative of positions of the adjustment images on the image support member, and the image forming apparatus comprises a pattern detecting device that detects the patterns, and wherein the output from said reading device with respect to the adjustment images starts being read in synchronization with timing in which the patterns are detected by said pattern detecting device.

7. An image forming apparatus according to claim 1, wherein the densities of the adjustment images are calculated based on differences in optical reflectivity between the image support member and the adjustment images.

8. An image forming apparatus according to claim 1, further comprising an image adjusting device that carries out image adjustment based on the output from said reading device, and the image support member comprises a drum, an endless belt, or a recording material.

9. An image forming apparatus that carries out image formation, comprising:

an image forming device that forms adjustment images having different densities on an image support member having a higher optical reflectivity than an optical reflectivity of the adjustment images so as to carry out image adjustment; and a reading device that reads the adjustment images, wherein an output from the reading device is read with the number of readings in reading an output from said reading device to a large value or with the time interval between readings set to a small value when the densities of the adjustment images are low, and with the number of readings set to a small value or with the time interval between readings set to a large value when the densities of the adjustment images are high.

10. An image forming apparatus according to claim 9, wherein the densities of the adjustment images are calculated based on differences in optical reflectivity between the image support member and the adjustment images.

11. An image forming apparatus according to claim 9, further comprising an image adjusting device that carries out image adjustment based on the output from said reading device, and the image support member comprises a drum, an endless belt, or a recording material.

12. A method of controlling an image forming apparatus that carries out image formation, comprising:

an image forming step of forming adjustment images having different densities on an image support member having a higher optical reflectivity than an optical reflectivity of the adjustment images; and a reading step of reading the adjustment images, wherein an output from said reading device is read at a predetermined number of readings or time interval between readings based on the densities of the adjustment images susceptible to the optical reflectivity of the image support member.

13. A method of controlling an image forming apparatus according to claim 12, wherein the output of said reading device is read with the number of readings set to a large value or with the time interval between readings set to a small value when the densities of the adjustment images are susceptible to the optical reflectivity of the image support member, and with the number of readings set to a small value or with the time interval between readings set to a large value when the densities of the adjustment images are not susceptible to the optical reflectivity of the image support member.

14. A method of controlling an image forming apparatus according to claim 13, wherein the densities of the adjustment images susceptible to the optical reflectivity of the image support member are low, and the densities of the adjustment images less susceptible to the optical reflectivity of the image support member are high.

15. A method of controlling an image forming apparatus according to claim 12, wherein in said image forming step, the adjustment images are decreased in size in a moving direction of the image support member as the adjustment images increase in density.

16. A method of controlling an image forming apparatus according to claim 15, wherein the number of readings or the time interval between readings is set based on the sizes of the adjustment images.

17. A method of controlling an image forming apparatus according to claim 12, wherein said image forming step comprises a pattern forming step of forming patterns indicative of positions of the adjustment images on the image support member, and the method of controlling the image forming apparatus comprises a pattern detecting step of detecting the patterns; and wherein the output from the reading device with respect to the adjustment images starts being read in synchronization with timing in which the patterns are detected in said pattern detecting step.

18. A method of controlling an image forming apparatus according to claim 12, wherein the densities of the adjustment images are calculated based on differences in optical reflectivity between the image support member and the adjustment images.

19. A method of controlling an image forming apparatus according to claim 12, further comprising an image adjusting step of carrying out image adjustment based on the output from the reading device, and the image support member comprises a drum, an endless belt, or a recording material.

20. A method of controlling an image forming apparatus that carries out image formation, comprising:

an image forming step of forming adjustment images having different densities on an image support member having a higher optical reflectivity than an optical reflectivity of the adjustment images so as to carry out image adjustment; and a reading step of reading the adjustment images, wherein an output in said reading step is read with the number of readings set to a large value or with the time interval between readings set to a small value when the densities of the adjustment images are low, and with the number of readings set to a small value or with the time interval between readings set to a large value when the densities of the adjustment images are high.

21. A method of controlling an image forming apparatus according to claim 20, wherein the densities of the adjustment images are calculated based on differences in optical reflectivity between the image support member and the adjustment images.

22. A method of controlling an image forming apparatus according to claim 20, further comprising an image adjusting step of carrying out image adjustment based on the output from the reading device, and the image support member comprises a drum, an endless belt, or a recording material.

* * * * *